United States Patent [19]

Fortsch

[11] Patent Number: 4,868,953

[45] **Date of Patent: * Sep. 26, 1989**

[54] ENVIRONMENTAL BUNDLING TIE

[75] Inventor: William A. Fortsch, Bernardsville, N.J.

[73] Assignee: Thomas & Betts Corporation, Bridgewater, N.J.

[ * ] Notice: The portion of the term of this patent subsequent to Aug. 23, 2005 has been disclaimed.

[21] Appl. No.: 179,143

[22] Filed: Apr. 8, 1988

Related U.S. Application Data

[63] Continuation-in-part of Ser. No. 24,639, Mar. 11, 1987, Pat. No. 4,765,032.

[51] Int. Cl.[4] ..... B65D 63/06

[52] U.S. Cl. ..... 24/23 R; 24/23 W; 24/25

[58] Field of Search ..... 24/23 R, 23 W, 25, 21, 24/20 LS, 616, 584; 285/365, 407, 242

[56] References Cited

U.S. PATENT DOCUMENTS

| | | | |
|---|---|---|---|
| 153,820 | 8/1974 | Goldsmith . | |
| 155,413 | 9/1874 | Boisseau | 24/21 |
| 201,431 | 3/1878 | Logue | 24/25 |
| 980,700 | 1/1911 | Swafford | 24/25 |
| 1,053,684 | 2/1913 | Vogel | 24/20 LS |
| 1,332,645 | 3/1920 | Turner | 24/21 |
| 2,273,007 | 2/1942 | Cooper | 24/23 W |
| 2,964,937 | 12/1960 | Lautin | 24/616 |
| 3,300,825 | 1/1967 | Andreasen | 24/25 |
| 3,587,142 | 6/1971 | Scaravelli | 24/268 |
| 4,015,311 | 4/1977 | Curtis | 24/23 R |

FOREIGN PATENT DOCUMENTS

| | | | |
|---|---|---|---|
| 0206710 | 2/1984 | German Democratic Rep. | 24/23 R |
| 137072 | 12/1919 | United Kingdom | 24/25 |
| 137029 | 11/1920 | United Kingdom | 24/25 |

*Primary Examiner*—Victor N. Sakran

*Attorney, Agent, or Firm*—Robert M. Rodrick; Salvatore J. Abbruzzese

[57] ABSTRACT

A self-locking bundling tie for engagement about electrical cables, pipes or the like is disclosed. The tie includes a head and a strap attachable to the head. The head comprises a housing and a planar locking insert slidably received in the housing cavity. The insert is movable between two locking position in the housing. In a first position, the insert has an opening for receipt of an end of the strap therethrough. Upon movement of the insert interiorly of the housing cavity to a second locked position, the insert opening with a portion of the strap end therethrough is moved interiorly of the housing and the strap end is deformed into a reverse bend to thereby lock the strap in the bundling tie head. The strap end may be severed at the housing. The insert includes an extending portion which extends beyond the end of the housing to protect the user from the sharp severed end.

10 Claims, 7 Drawing Sheets

FIG. 5
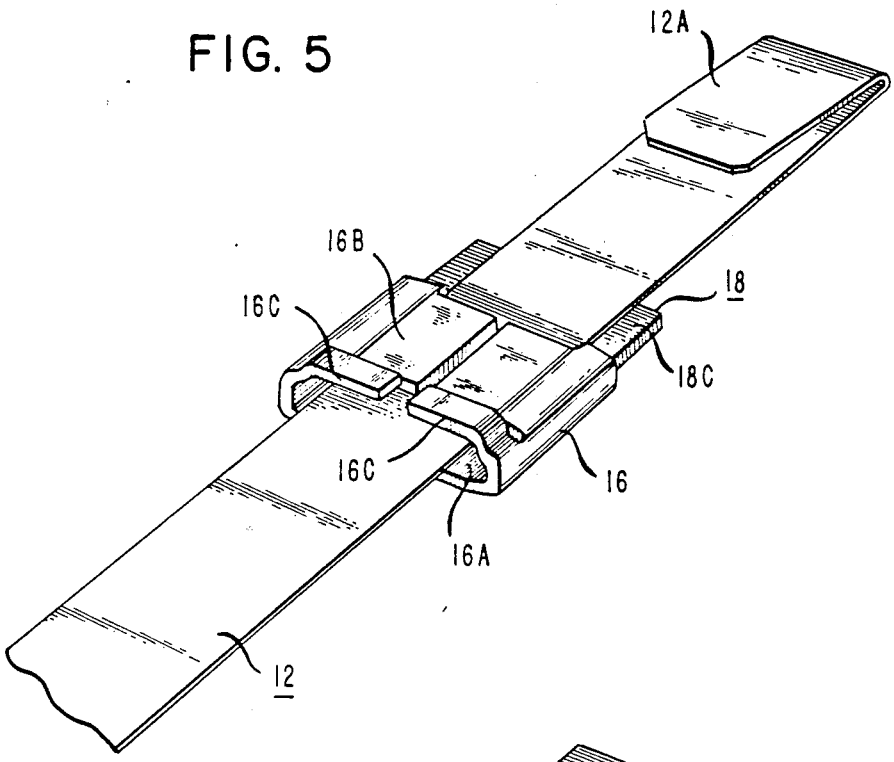
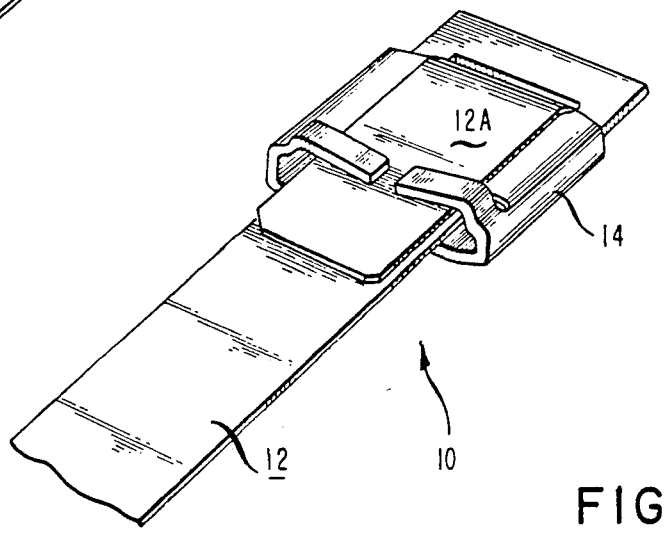
FIG. 1

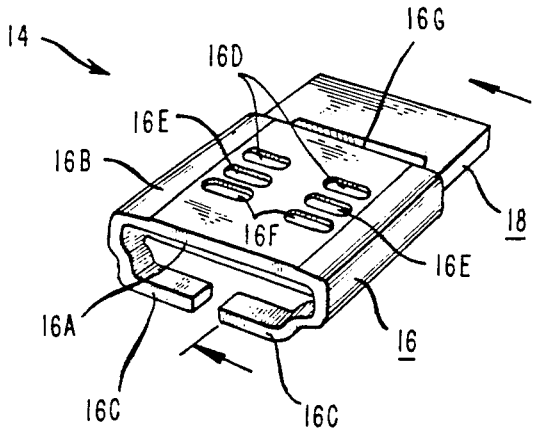
FIG. 2
FIG. 3
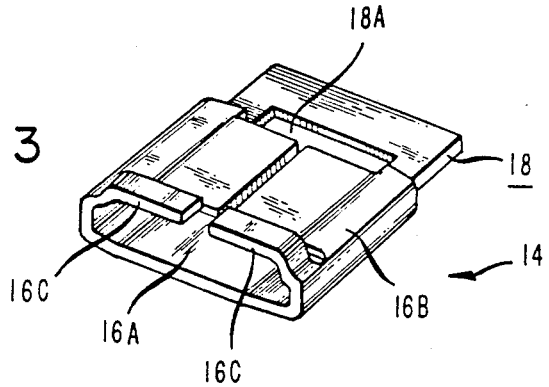
FIG. 4
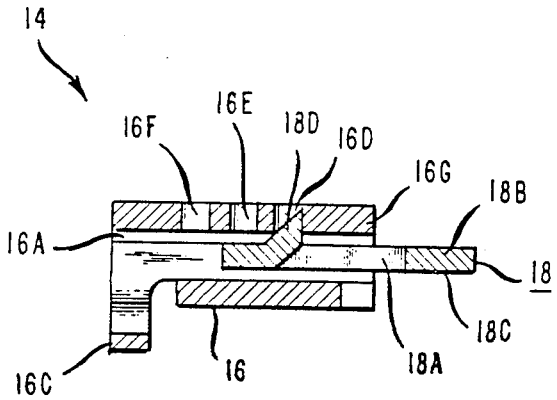

ENVIRONMENTAL BUNDLING TIE

CROSS REFERENCE TO RELATED APPLICATION:

The present application is a continuation-in-part of application Ser. No. 024,639 filed March 11, 1987, now U.S. Pat. 4,765,032; issued Aug. 23, 1988.

FIELD OF THE INVENTION

This invention relates to a bundling tie and more particularly to an improved self-locking bundling tie for use in harsh environment.

BACKGROUND OF THE INVENTION:

There is a need in industry and, in particular in environments, where the conditions are adverse, such as in the telecommunications, marine and chemical plant environments for a bundling tie capable of standing-up to such environments. For example, such ties may be used to hold electrical cables, piping, or in duct work where temperature extremes may be severe and atmospheric conditions may contain corrosive elements.

In such environments, stainless steel bundling ties are in present use for their strength, longevity and ability to withstand the adverse environments. Bundling ties formed of stainless steel and other metals are shown for example in U.S. Pat. Nos. 4,366,602; U.S. 4,128,919; U.S. 3,311,957; U.S. 3,964,133; and U.S. 3,694,863. While these ties are capable of withstanding adverse environments, there is a need with some of these ties for the user to have a special tool to apply the bundling ties properly about a plurality of articles such as cables or pipes. Such tools may provide suitable tensioning to the strap and subsequent severing of the strap tail after the suitable tension has been achieved. As a sharp edge commonly occurs as a result of the cutting of the strap.

There is need to provide a strap which is capable of being severed at the tail without use of a special tool. Also, there is a need to provide a strap where the severed edge is kept away from the user so as to prevent injury.

SUMMARY OF THE INVENTION:

It is an object of the present invention to provide an improved bundling tie.

It is a further object of the present invention to provide an improved self-locking bundling tie that is useful in harsh, adverse environments.

In the efficient attainment of these and other objects the present invention provides a self-locking bundling tie for securement about an elongate article bundle comprising a bundling strap having a fixed termination end and a tail and a strap head engageable with the fixed termination end of the strap. The strap head includes an elongate housing having an open tail accommodating end and an opposed egressing end. The strap head further includes an insert having a first end insertably accommodated in the housing through the tail accommodating end, a second end and a second transverse opening intermediate the first and second end for permitting passage of the strap tail therethrough. The insert is slidably insertable into the housing between two locking positions. The first locking position disposes the central opening exteriorly of the housing permitting loose accommodation of the tail therethrough. The second position disposes the opening interiorly of the housing to deform the strap and to lock the strap in position in the housing. The second end of the insert extends exteriorly of the housing in the second position so that the longitudinal end of the strap head extends beyond the tail accommodating end of the housing. Thus, the user who may cut the strap tail at the housing would be protected from the sharp cut end of the strap.

As shown particularly by way of a preferred embodiment, the insert includes a tapered front end which may be engaged by a pair of pliers or the like to compress the insert into the housing. The insert end extends beyond the housing so that the strap head may be locked without need to cut the tail from the remainder of the strap prior to locking. Also, once the strap is locked in the head, the end may be severed adjacent the housing and the user will be protected from the sharp, severed end by the extending portion of the insert.

BRIEF DESCRIPTION OF THE DRAWINGS:

FIG. 1 is a bottom perspective, partial view of the bundling tie of the present invention showing the bundling tie strap head in assembled condition.

FIG. 2 is a top perspective view of the bundling tie head of the tie shown in FIG. 1.

FIG. 3 is a bottom perspective view of the bundling tie head of FIG. 2.

FIG. 4 is a cross-sectional view of the bundling tie head as seen along viewing lines IV—IV of FIG. 2.

FIG. 5 is a bottom perspective view of the bundling tie of FIG. 1 showing the tie strap and head in disassembled condition.

Figure 6:
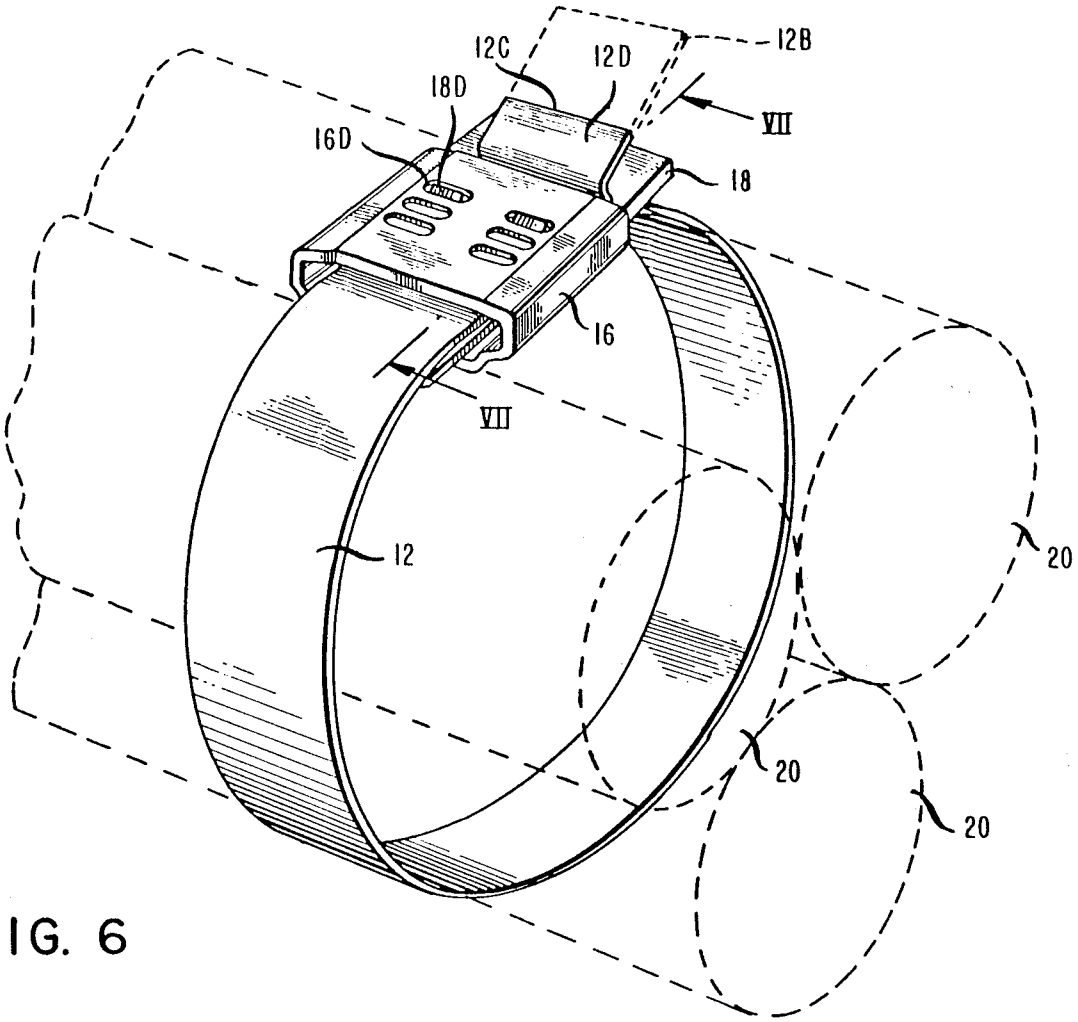
FIG. 6 is a perspective view of the bundling tie of the subject invention shown in application about a plurality of articles and prior to locking.

DETAILED DESCRIPTION OF THE PREFERRED EMBODIMENTS:

Referring now to the drawings figures, there is shown in FIG. 1 a bundling tie 10 in accordance with the subject invention. Tie 10 comprises an elongate, flexible flat strap 12 that is suitably attached at one end 12A thereof to a tie head 14. In the preferred form of the invention, the bundling tie strap 12 and head 14 are separably attached, the details of which will be described hereinafter, and the strap 12 and head 14 are both formed of a metallic material, in particular, stainless steel, for its strength and specific use in harsh environments.

Referring now to FIGS. 2, 3 and 4, the details of the bundling tie head 14 are more fully described. The bundling tie head 14 comprises a housing 16 and a locking insert 18, both, in the preferred form, being formed of stainless steel. The housing 16, formed of a generally tubular, hollow construction, has a cavity 16A extending fully through the walls 16B of the housing 16. The housing walls 16B are formed such that the cavity 16A has a generally rectangular shape. At the lower portion of the rear face of the housing 16, there extends a pair of deformable arms 16C, separably facing each other. At the upper portion of the housing 16, there are two rows of three recesses 16D, 16E and 16F spaced from each other and extending through the upper wall of the housing to communicate with the cavity 16A. However, any number of recesses may be utilized, with there being at least two recesses spaced differently from the front face 16G of the housing. In a preferred form, housing 16 may be made by a conventional stamping technique and folding the housing into the configuration as shown such that the walls 16B at the bottom thereof are slightly spaced as illustrated in FIG. 3.

Referring still to FIGS. 2, 3 and 4, insert 18 is formed as a generally planar, flat member. Insert 18 has an opening 18A extending through its upper and lower surfaces 18B and 18C, opening 18A being configured to receive the unattached end of the strap 12 therethrough, as will be described. Insert 18 is slidably received in the housing cavity 16A from the front face 16G of the housing 16. Insert 18 preferably has two laterally spaced barbs, 18D projecting upwardly from insert upper surface 18B. Barbs 18D are particularly configured to engage the housing recesses 16D, 16E and 16F, in a manner to retentively hold the insert 18 in a fixed position relative to the housing 16 when the barbs 18D are in each of the recesses 16D, 16E and 16F. Barbs 18D are specifically formed such that insertion of the insert 18 into the cavity 16A is permitted while the cooperative latching between the barbs and the recesses in the housing prevents withdrawal of the insert 18. By further reference to FIG. 4, when the insert 18 is disposed in the housing 16, such that the barbs 18D are in the recess 16D closest to the front face 16G of the housing 16, insert opening 18A has a portion thereof lying exteriorly of the housing 16.

Turning now to FIG. 5 and also again to FIG. 1, the assembly of the bundling tie in accordance with the preferred construction is described. One end 12A of the bundling tie strap 12, which may be formed in predetermined lengths or cut to a suitable size by a user, is folded back over the remainder of the strap 12. The opposite end (not shown) of the strap 12 is then inserted through the housing cavity 16A against the lower surface 18C of the insert 18. The strap is inserted until the folded end 12A extends over the bottom walls of the housing and beneath the crimpable arms 16C in a manner as shown in FIG. 1. Upon seating the strap 12 in this position, a suitable tool such as conventional pliers, is then used to deform the arms 16C in crimped fashion against the folded strap portion 12A to mechanically secure the head 14 and the strap 12 in attached condition.

Figure 7:
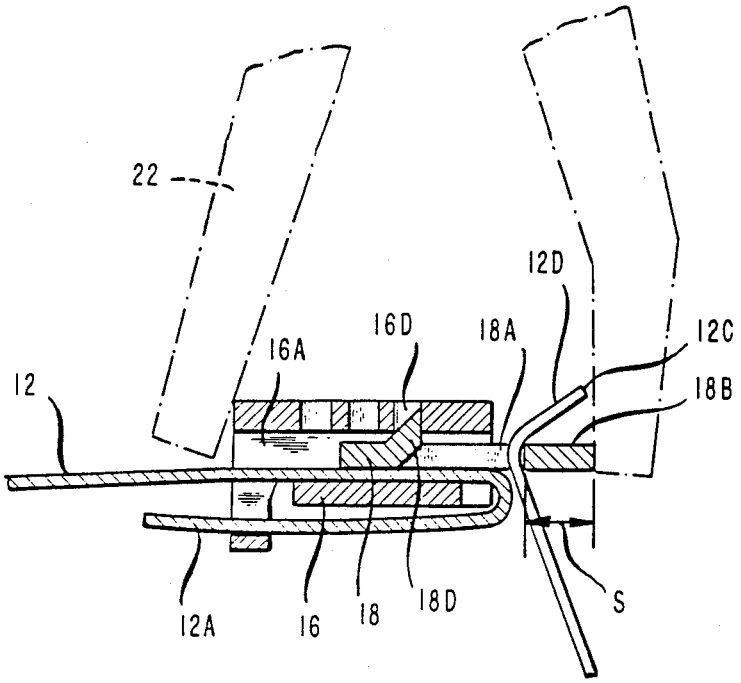
FIG. 7 is a cross-sectional view of the bundling tie head a strap as seen along viewing lines VII—VII of FIG. 6.

Turning now to FIGS. 6–9, the application of the bundling tie of the subject invention is set forth. As seen in FIGS. 6 and 7, the unattached end 12B of the strap 12 is encircled around a plurality of articles 20 such as electrical cables or pipes. The strap end 12B is fed through the insert opening 18A, opening 18A being accessible as the insert 18 is in a first position where the locking barbs 18D are latched in recesses 16D of the housing 16. Once extending through the opening 18A, the strap is pulled snugly about the articles 20 and end 12B is bent forwardly in a manner as shown in FIG. 6. Strap end 12B is then cut to provide a cut end 12C. The length of the extent 12D of the strap portion extending through the opening 18A above insert surface 18B is preferably less than the spacing S of the front end of the insert 18 as seen in FIG. 7.

Figure 9:
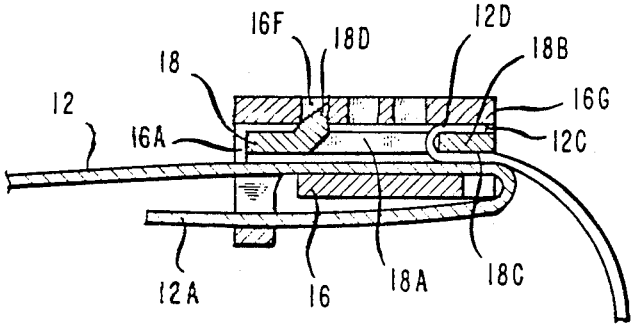
FIG. 9 is a cross-sectional view of the bundling tie head as seen along viewing lines IX—IX of FIG. 8.
Figure 8:
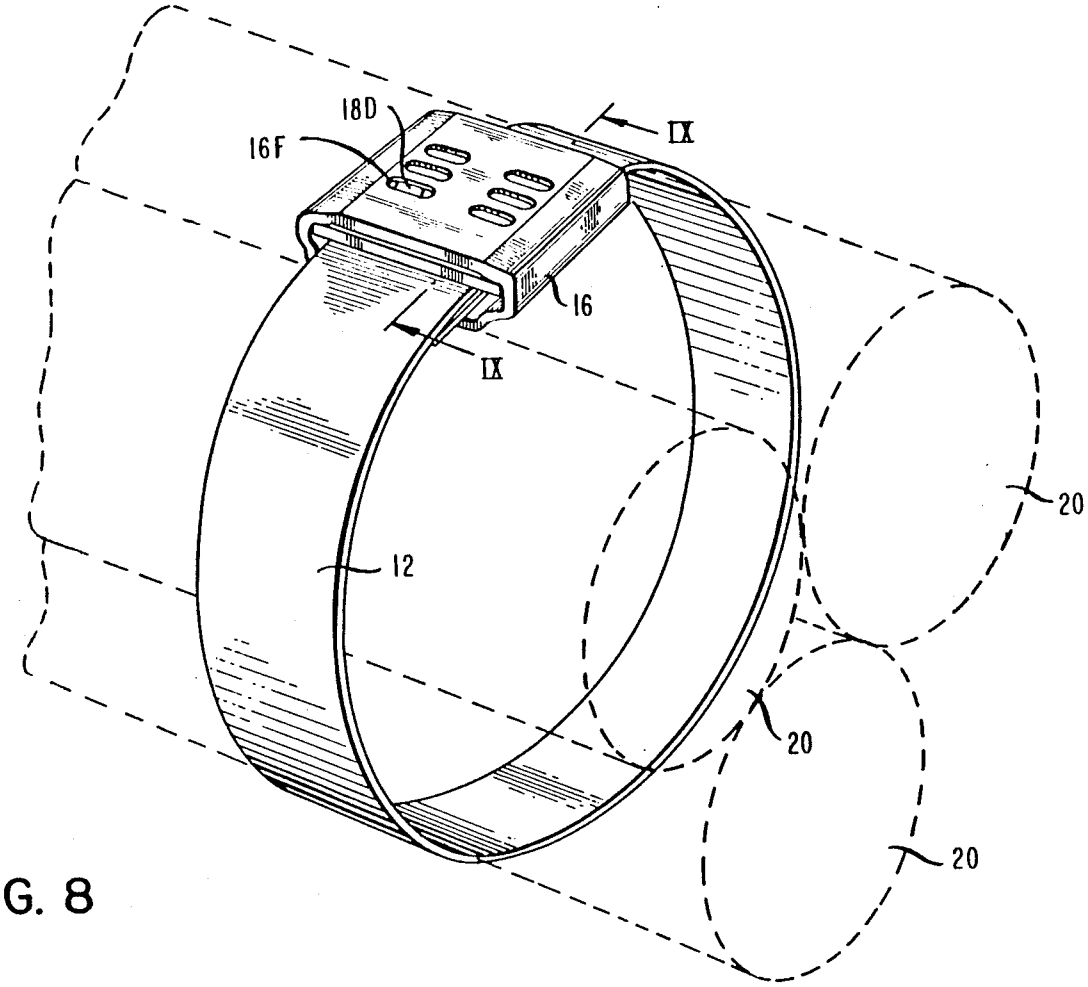
FIG. 8 is a view of the bundling tie of FIG. 6 as shown in locked condition.
Figure 12:
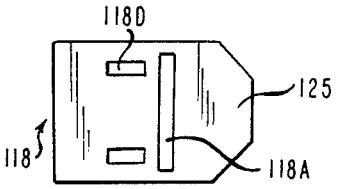
FIG. 12 is a top plan view of an insert of the bundling tie of FIG. 10.

Upon movably sliding the insert 18 inwardly in housing cavity 16A by a conventional tool such as pliers 22, the strap 12 is locked about the articles 20 as illustrated in FIGS. 8 and 9. Upon sliding the insert 18 into the cavity 16A, barbs 18D are moved from the first recesses 16D to one of the next recesses 16E or 16F, wherein insert 18 is locked thereat. As illustrated in the drawing figures, barbs 18D are situated in recesses 16F. During this movement, the opening 18A together with the end of the strap 12 therein are moved inwardly of the housing 16 in such a manner as to deform the strap in a reverse fold such that extent 12D lies adjacent insert surface 18B reversely from a portion of the strap 12 lying adjacent insert surface 18C. In this condition, the double bend of the strap end provides a secure locking arrangement in the bundling tie head. Furthermore, the movement of the locking insert 18 from the first recesses 16D to the third recesses 16F provides a further take-up or tightening of the strap 12 about the articles 20. In addition, the cut end 12C which may have a sharp edge is disposed interiorly of the housing and within the cavity 16A thereby locating end 12C in a manner to minimize potential injury to a user. While it is desirable that cut end 12C be disposed within housing 16, it should be understood that locating the cut end 12C closely adjacent the front face 16G of the housing will help to keep the cut end 12C away from the user.

Referring now specifically to FIGS. 10 through 13, an alternate embodiment of the present invention is shown. The bundling tie shown in FIGS. 10 through 13 is substantially similar to that which is described above. Accordingly, for simplification of description, similar elements will be denoted by similar reference numerals.

Bundling tie 110, as shown in the preferred embodiment herein, includes an elongate flexible strap 112 which is attachable at end 112A to a tie head 114. As with the above described embodiment, bundling tie head 114 includes an elongate rectangularly shaped housing 116 and an elongate flat, planar locking insert 118 which are preferably formed of stainless steel. The under surface of housing 116 includes a rectangular opening 121 which accommodates an inwardly lanced portion 123 of strap end 112A. This serves to secure strap 112 in bundling tie head 114. As with the embodiment described above, the strap 112 may be permanently secured to tie head 114 or may be provided disassembled for ultimate assembly by the user.

Figure 10:
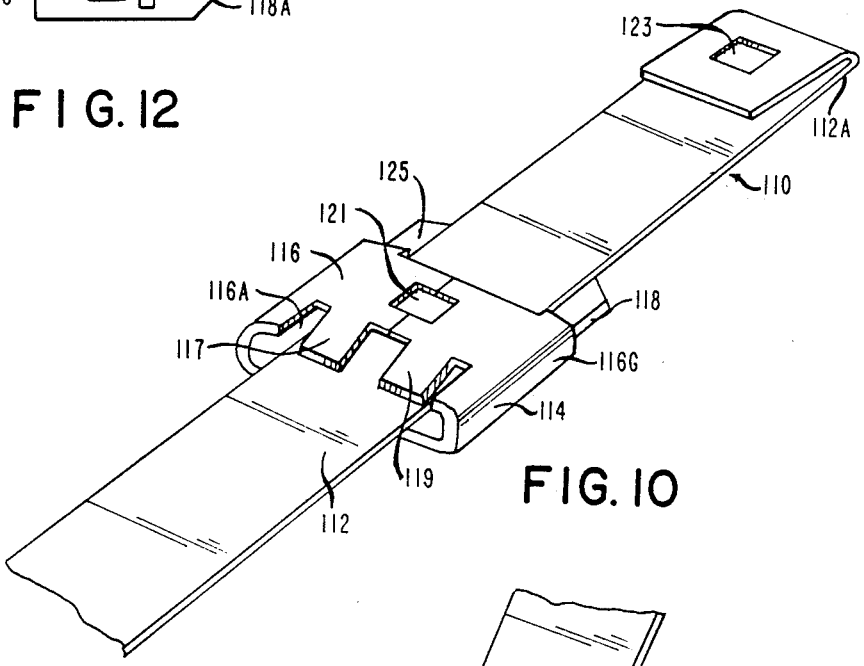
FIG. 10 is a bottom perspective view of an alternate embodiment of the bundling tie of the present invention, shown in disassembled condition.
Figure 13:
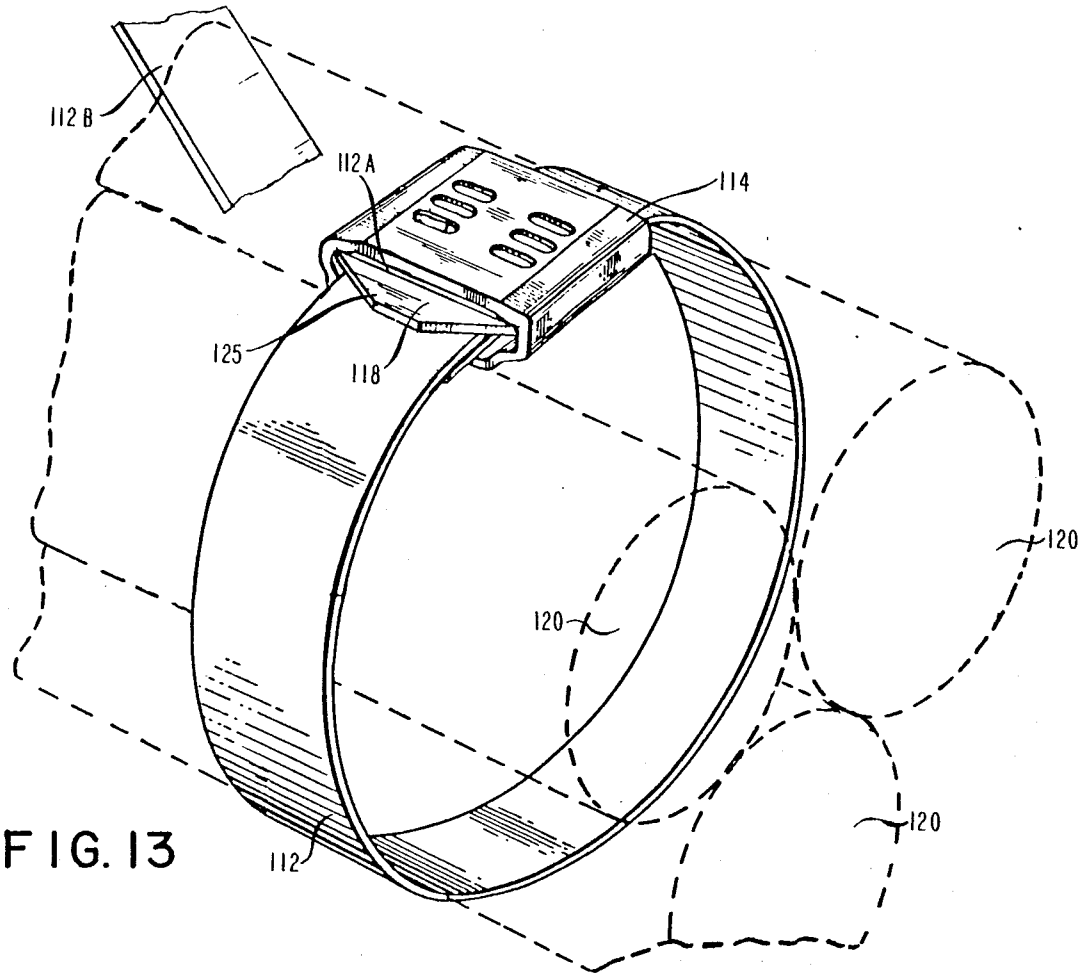
FIG. 13 is a perspective view of the bundling tie of FIGS. 10 and 11 shown locked about a plurality of articles.

Insert 118 is similar to insert 18 described above and is lockingly cooperative with housing 114 in a manner described above to secure strap 112 in bundling tie head 114. A transverse opening 118A of insert 118 accommodates an end extent 112B of strap 112 therethrough. This end extent 112B is loosely held in insert 118 through opening 118A. Insert 118 is slidably received in housing cavity 116A from the front face 116G thereof. Insert 118 locks into housing 114 in a manner described above. Pairs of barbs 118D of insert 118 (FIG. 12) engage progressively pairs of recesses 116D, 116E and 116F of housing 116 (FIG. 11) to move insert 118 to a locked position. As above described, each of the pairs of recesses 116E and 116F provide for a further take up or tightening of the strap 112 about articles 120 (FIG. 13). Thus, further tightening may be achieved by moving the pairs of barbs 118D from the second to the third recesses. However, to achieve this flexability and to permit movement of the barbs 118D from recesses 116E to 116F when strap 112 is partially tightened, the under surface of housing 116 includes a pair of extending spring fingers 117 and 119 (FIG. 10). Upon further hand tightening of strap 112 the spring fingers 117 and 119 will slightly flex so that it is possible to further progress the insert from a position where the barbs 118D engage recesses 116E to a position where the barbs 118D engage recesses 116F. Thus, these spring fingers 117 and 119 provide for further tightening of the strap 112 in use.

In the present embodiment, insert 118 includes an extension portion 125 which extends beyond the front face 116G of housing 116. Extension portion 125 is preferably integrally formed with insert 118 and is formed into the shape of a frontwardly tapering regular trapezoid, although any other suitable shape may also be employed. Extending portion 125 extends beyond the end face 116G of housing 116 in both in the position shown in FIG. 11 and in the locked position shown in FIG. 13.

Figure 11:
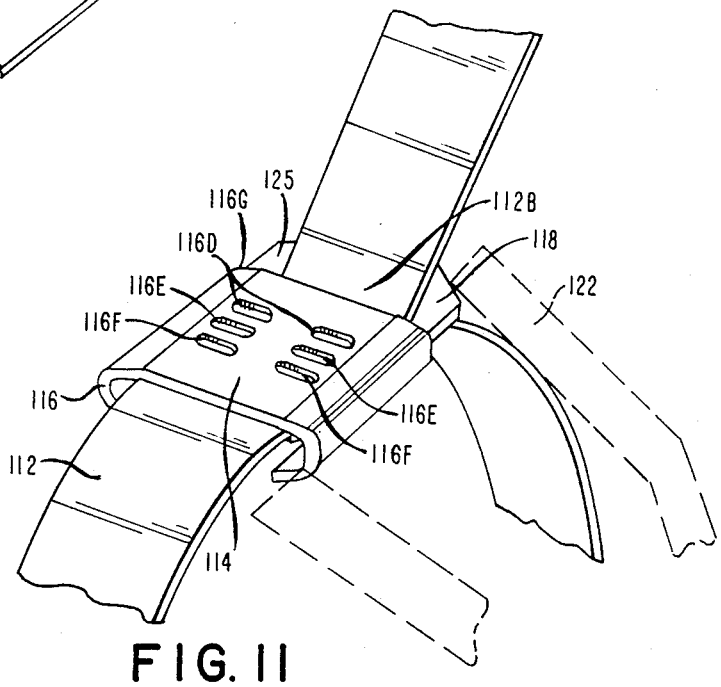
FIG. 11 is a perspective view of the bundling tie of FIG. 10 prior to being placed in locked condition by a plier type tool shown in phantom.

Extending portion 125 provides two advantages. First, it is capable of being engaged by conventional tools such as pliers 122 from the side as shown in FIG. 11 with the entire strap end substantially extending beyond tie head 114. This permits the user to make only one cut of the strap after the strap is locked into the housing. The user is also provided with a more convenient surface against which to apply the pliers 122. A second advantage provided by extending portion 125 is that, it remains exteriorly of front face 116G of housing 116 in the locked position. Thus, the strap may be severed at location 112C by repeatedly flexing the strap 112 thereat. No special cutting tool is needed. Severing in this manner may provide a sharp or ragged end 112C which could cut or injure the user. However, the extending portion 125B protects the user from contacting the severed end 112C thus avoiding a potential injury.

Having described the preferred embodiments of the self-locking bundling tie of the present invention, the benefits and advantages thereof should be appreciated. For example, no special tools are required other than a conventional pair of pliers, any slack or looseness in the tie strap is tightened during the final locking stages upon movement of the locking insert, and sharp edges are disposed in a manner to minimize access to a user. It should also be appreciated that modifications or variations of the subject invention may be made during the practice of the invention without departing from the contemplated scope. For example, while the bundling tie has been described herein as preferably made of stainless steel for particular use in harsh environments, it should be understood that other materials having suitable strength and capacity for wear and tolerance in such harsh environments may also be used. Furthermore, while in the preferred embodiment of the bundling tie a strap and head are separably attached so that strap lengths may be provided to suit the users particular dimensions, it should be understood that a strap of fixed length may be provided with the strap and head securely fixed upon manufacture. Accordingly, the embodiments described herein are intended in an illustrative rather than a limiting sense, the true scope of the invention being set forth in the claims appended hereto.

I claim:

1. A self-locking bundling tie for securement about an elongate article bundle comprising:

an elongate bundling strap having a fixed termination end and a tail;

a strap head engaged with said fixed termination end of said strap, said strap head including:

(a) an elongate housing having an open tail accommodating end and an open opposed egressing end; and (b) an elongate insert having a first end insertably accommodated in said housing through said open tail accommodating end thereof, a second end and a central transverse opening intermediate said first and second ends for permitting passage of said strap tail therethrough and for loosely accommodating an intermediate portion of said strap therein;

said insert being slidably insertable into said housing between at least two locking positions, said first locking position disposing said central opening exteriorly of said housing thereby permitting said loose accommodation of said intermediate portion of said strap and a second position disposing said opening interiorly of said housing to deform said strap adjacent said intermediate portion thereby securing said strap in said housing, said second end of said insert extending exteriorly of said housing in said second position, said second end of said insert defining a longitudinal end of said strap head beyond said tail accommodating end of said housing.

2. A bundling tie of claim 1 wherein in said second position said strap includes a folded portion adjacent said deformed portion so that said tail extends exteriorly of said housing through said tail accommodating end.

3. A bundling tie of claim 2 wherein said strap includes a transverse severing location adjacent said tail accommodating end of said housing.

4. A bundling tie of claim 3 wherein said transverse severing location is located inwardly of said second end of said insert.

5. A bundling tie of claim 3 wherein said second end of said insert provides a tool engagement surface for accommodating a tool for movement of said insert from said first position to said second position.

6. A method of bundling elongate articles comprising the steps of:

providing an elongate metallic strap having a first end and a second tail end;

providing a strap head attached to said first end of said strap, said head including an elongate housing having opposed open ends, said head supporting an elongate insert having a first end insertable into said housing and a second end, said insert further including a transverse opening therethrough disposed intermediate of said insert ends;

encircling said articles transversely with said strap;

inserting said tail of said strap through said opening in said insert so that said insert supports an intermediate extent of said strap;

sliding said insert into said housing to insertably deform said strap in said housing at said intermediate extent thereof;

locking said insert supporting said strap in said housing; and severing said strap tail from the remainder of the strap at a location between said insert opening and said second end.

7. A method of claim 6 wherein said strap is provided with said strap head attached to said first end of said strap.

8. A method of claim 6 wherein said severing step includes:

repeatedly flexing said strap tail to sever said tail adjacent one end of said housing.

9. A method of claim 6 wherein said severing step is subsequent to said sliding step.

10. A method of claim 6 wherein said sliding step and said locking step are accomplished substantially simultaneously.

* * * * *